US005979076A

United States Patent [19]

Li

[11] Patent Number: 5,979,076

[45] Date of Patent: Nov. 9, 1999

[54] VENTILATING SHOE AND METHOD OF MAKING SAME

[76] Inventor: Zheng Li, No. 11, Nanshuncheng Road, Shenhe District, Shenyang, China, 110011

[21] Appl. No.: 08/871,685

[22] Filed: Jun. 9, 1997

[51] Int. Cl.[6] ..... A43B 7/06; A43B 13/20

[52] U.S. Cl. ..... 36/3 B; 36/3 R; 36/141; 36/29; 36/43

[58] Field of Search ..... 36/3 R, 3 A, 3 B, 36/141, 28, 29, 43

[56] References Cited

U.S. PATENT DOCUMENTS

| | | | |
|---|---|---|---|
| 1,949,159 | 2/1934 | Glidden et al. | 36/3 A |
| 2,098,412 | 11/1937 | Bovay | 36/3 R |
| 2,344,762 | 3/1944 | Wylie | 36/3 B |
| 2,402,534 | 6/1946 | Crum | 36/35 R |
| 2,713,215 | 7/1955 | Cosneck | 36/44 |
| 4,185,402 | 1/1980 | Digate | 36/3 B |
| 4,257,176 | 3/1981 | Hartung et al. | 36/3 B |
| 4,533,351 | 8/1985 | Washkuhn | 36/43 |
| 4,805,319 | 2/1989 | Tonkel | 36/28 |
| 4,837,948 | 6/1989 | Cho | 36/3 A |
| 4,939,851 | 7/1990 | Miller | 36/3 B |
| 5,086,572 | 2/1992 | Lee | 36/3 R |
| 5,172,494 | 12/1992 | Davidson | 36/35 R |

*Primary Examiner*—Paul T. Sewell
*Assistant Examiner*—Anthony Stashick
*Attorney, Agent, or Firm*—Smith, Gambrell & Russell, LLP; Beveridge, DeGrandi, Weilacher & Young; Intellectual Property Group

[57] ABSTRACT

A shoe according to a preferred embodiment of the present invention includes a novel and non-obvious sole having a rubber base and a fiber cushion. Patterned nodes are centered on the rubber base and a plurality of elongated rectangular nodes are arranged around the edge of the rubber base. An extra rim is disposed at the upper edge of the sole to attach the sole to the remaining portion of the shoe. There are ventilating holes along the outer edge of the sole. The heel is formed with a grid pattern defining chambers and is supported by internal reinforcing members. The fiber cushion of the sole's upper layer allows for ventilation between the interior of the shoe and the ventilating holes.

2 Claims, 3 Drawing Sheets

VENTILATING SHOE AND METHOD OF MAKING SAME

FIELD OF THE INVENTION

This invention relates to a ventilating shoe with the unique functions of ventilating the foot of the wearer while simultaneously massaging the bottom of the wearer's foot, thus not only decreasing or preventing perspiration of the foot but also stimulating the foot as the wearer walks, runs or jogs.

BACKGROUND OF THE INVENTION

Applicant's inventive shoe provides a surprisingly positive effect on the health and fitness of the foot of the wearer. Numerous shoes have been designed and introduced into the market in an attempt to receive the results of the Applicant's shoe, without success. This lack of success is due to several reasons: unbecoming appearance, uncomfortableness and lack of durability. The Applicant applied for a patent for his original invention entitled "Perspiration and Odor Preventing Shoes" on Jul. 6, 1991 and obtained Patent No. 91210858.4 on Sep. 2, 1992. After several years of further research and gathering feedback from the market place, a great deal of experience in the selection of shoe material and in manufacturing techniques has been accumulated, which has spawned the particular structure and supporting means of the sole of the shoe of the present invention and a method for manufacturing the shoes.

OBJECT OF THE INVENTION

The purpose of this invention is to create a ventilating shoe having a new sole comprising a rubbery base and a top layer of fiber cushion. The rubbery base of the sole has a plurality of nodes and ventilating openings and passageways arranged in a pattern to provide for the ventilation of the wearer's foot and simulatanously massage the bottom of the wearer's foot. Many benefits therefore are provided such as health protection, durability and practicality.

SUMMARY OF THE INVENTION

A shoe according to a preferred embodiment of the present invention includes a novel and non-obvious sole having a rubber base and a fiber cushion. Patterned nodes are centered on the rubber base and a plurality of elongated rectangular nodes are arranged around the edge of the rubber base. An extra rim is disposed at the upper edge of the sole to attach the sole to the remaining portion of the shoe. There are ventilating holes along the outer edge of the sole. The heel is formed with a grid pattern defining chambers and is supported by internal reinforcing members. The fiber cushion of the sole's upper layer allows for ventilation between the interior of the shoe and the ventilating holes.

The fiber cushion is sewed with visible strings and glued together before it is seamed and glued to the edge of sole. This procedure can be summarized as follows: sewing, stretching, drying, and final stitching. Stretching means that the fiber cushion and the edge of the shoe's upper layer are glued and nailed together first, then stretched onto a shoe tree. Afterwards, they are placed in a furnace which is at a temperature of about 80° Centigrade to be heated for about six hours. When they are removed from the furnace, they are dried and shaped into a primary shoe. The nails then are removed and the seams are leveled. After the seams are leveled, they are sanded and wrapped with leather identical to that used in making the upper portion of the shoe so that they can be glued and stitched to the sole's edge from within. The aforesaid fiber cushion is made of layers of pure cotton. The seaming of the cushion and the shoe upper requires 3 stitches per inch and 5 stitches at the seams. When stitching the sole and the top, it requires 3.5 stitches per inch and 3 stitches per inch at the seam.

The present invention has the following advantage and effects:

1. The patterned nodes centered on the rubber base of the sole massage the foot.
2. The patterned nodes in the elongated, substantially rectangular or partially arcuate shape around the edge of the rubber base of the sole reinforce the internal supports and prevent the shoe's loss of shape.
3. The nodes create plenty of surface area for the foot to touch and to be supported and thus makes walking smooth and steady.
4. The reinforcing members included in the heel produce a cushioning effect that relaxes and soothes the foot muscles.
5. The holes and nodes around the edge of rubber base are open to each other, i.e., in communication, so an airflow can circulate within the shoe. Employing this technique, perspiration is absorbed and aerated through the fabric cushion.
6. The fabric cushion making up the surface of the sole is not necessarily only made of pure natural cotton, but can also be specially treated or infused with a chemical, such as a deoderant, a fungicide, bactericides or a medication, such as is used in the treatment of athletes's foot. This process promotes durability, toughness and aeration while also preventing and treating athlete's foot, for example.
7. The method that joins the fiber cushion with the shoe upper before joining with the sole makes shoes integrated, prevents deformation of shoe shape and creates a better looking appearance for the shoe.

Therefore, a shoe in accordance with one aspect of the present invention includes a sole having a bottom portion and a top portion spatially biased by an outer portion to define a ventilation area. A plurality of border nodes are disposed in the ventilation area and are arranged proximal to the outer portion of the sole. A plurality of central nodes also are disposed in the ventilation area and are arranged such that the border nodes at least partially surround the central nodes. At least one ventilation port is defined through the outer portion of the sole and is in fluid communication with a space outside of the shoe through the ventilation port.

In a preferred variation thereof, a heel portion is engaged with the sole portion and has an interior chamber defined therein. The interior chamber is divided into a plurality of support chambers by a plurality of support members and thereby define, in a further variation thereof, rectangular support chambers in a matrix shape. The heel and sole portions may be integral with the sole. Also, the top portion of the sole in another preferred embodiment is permeable to fluid thereby placing the ventilation area in fluid communication with the interior of the shoe.

In another preferred variation, a shoe according to the present invention also includes a rim disposed proximal to the outer portion of the sole which connects the top portion of the shoe to the outer portion of the sole. Also, the top portion of the sole can include a medicinal substance for treating, i.e., athlete foot, while wearing the shoe.

A shoe according to another preferred embodiment of the invention includes an upper portion having an interior for receiving a foot of a user, a sole portion fixed with the upper portion, a massaging means for massaging the foot of the user disposed in the sole portion of the shoe and a ventilating means for ventilating the foot of the user disposed in both the upper portion and the sole portion of the shoe. The massaging means comprises a plurality of centered nodes and a plurality of border nodes arranged such that the border nodes at least partially surround the centered nodes. Also, the ventilating means comprises a permeable portion of the sole, a ventilation area defined in the sole, and a ventilation port, The interior of the upper portion thus being in fluid communication with a space outside of said shoe via the permeable portion, the ventilation area and the ventilation port.

BRIEF DESCRIPTION OF THE DRAWINGS

The above advantages and objects of the present invention will now become even more apparent from the following detailed description and drawings in which.

DETAILED DESCRIPTION OF THE DRAWINGS

Figure 1:
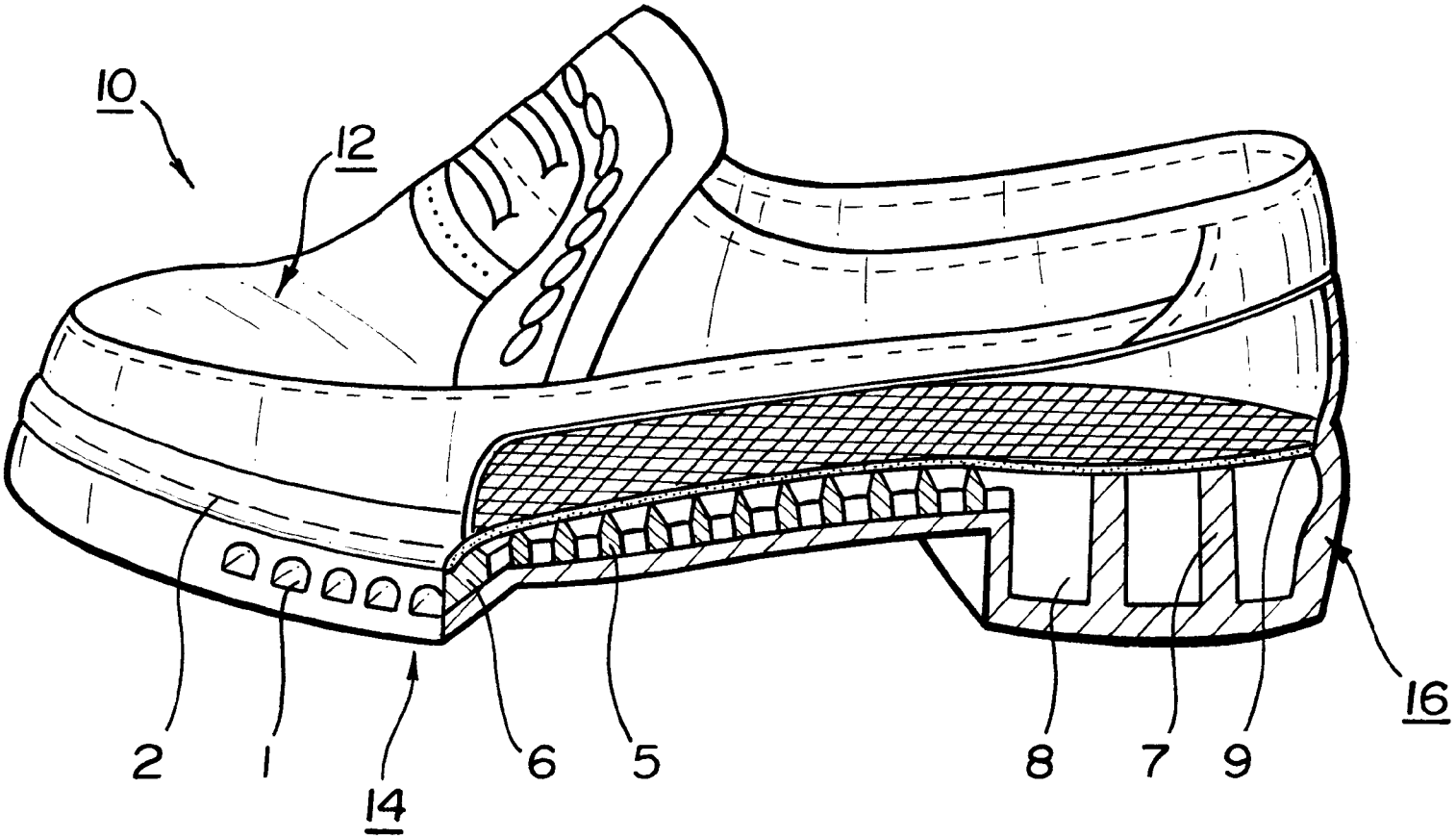
FIG. 1 is a partially cut away illustration of the shoe of the invention.
Figure 3:
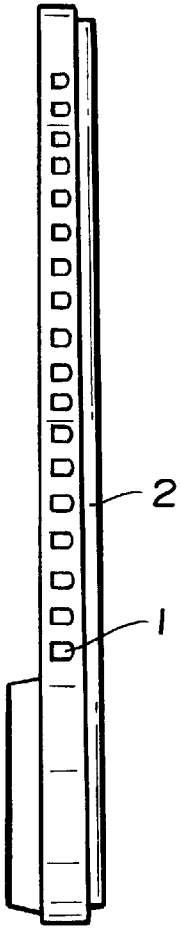
FIG. 3 is a side view of the sole of the shoe.
Figure 2:
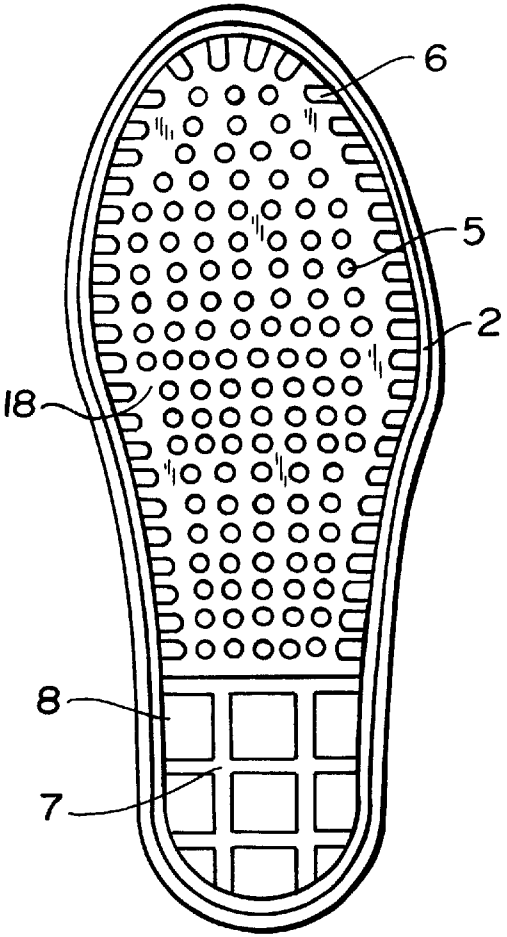
FIG. 2 is a cross-sectional view of the sole of the shoe.

Referring to FIGS. 1–3, a shoe 10 having a sole in accordance with a preferred embodiment of the present invention generally is shown. The shoe 10 preferably is comprised of two main components, an upper portion 12 and an integral sole 14 and heel 16 portion. One of ordinary skill in the shoe manufacturing industry would readily appreciate, however, that the inventive features of the integral sole 14 and heel 16 portion of the shoe 10 effectively can be separated, in another preferred embodiment, into individual heel and sole components. Such an embodiment would have an advantage of, for example, the heel component being independently replaceable.

Figure 4:
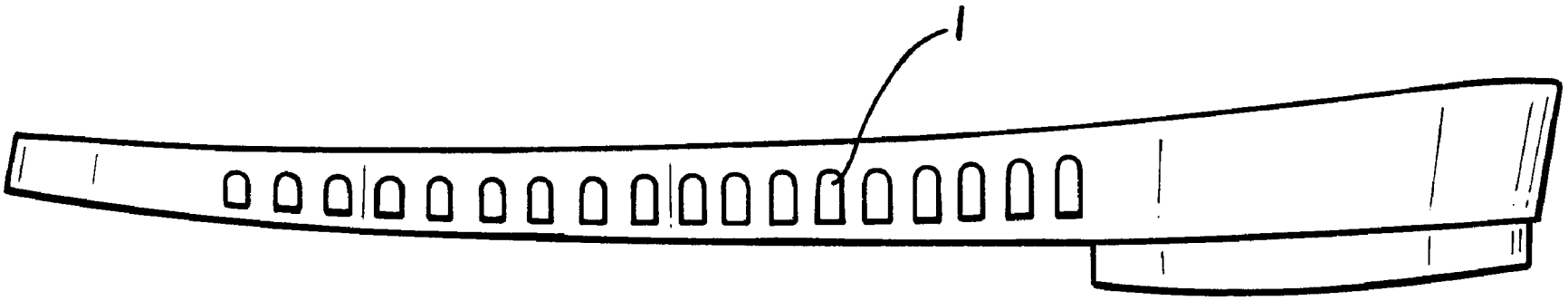
FIG. 4 is a side view of the sole of the shoe formed in accordance with a prefered variation of the shoe shown in FIGS. 1–3.

The sole portion 14 of the shoe 10 includes both a ventilating means and a massaging means. The sole portion 14 can also include a raised rim 2 for attaching the sole portion 14 with the upper portion 12 of the shoe 10, as shown in FIGS. 1–3, although other attachment means can be suitable used. If other attachment means are used, the sole portion 14 of the shoe of the present invention can be formed without the raised rim 2, as shown in FIG. 4.

The massaging means preferably comprises a plurality of centered nodes 5 circumscribed by a plurality of border nodes 6. The centered nodes 5 extend from the sole portion 14 toward the inside of the shoe 10 and thus are proximal to the bottom of where a user's foot is disposed when the shoe 10 is being worn. The centered nodes 5 are flexible and resilient so that pressure caused by, for example, a user walking or jumping, is partially absorbed and dissipated by the spring-like motion of centered nodes 5. Thus, the centered nodes 5 effectively reduce high impact stress on a user's foot while also providing a pleasant massaging feeling. The border nodes 6 are elongated, relative to the centered nodes 10, can be rectangular, arcuate or any other suitable shape and are disposed along the border of the sole portion 14, as is best seen in FIG. 2. The border nodes 6, because they are elongated, offer additional support at the border of the sole portion 14 and help maintain the original shape of the sole portion 14, and thus of the shoe 10, after use.

As one of ordinary skill in the art would readily appreciate, the dimensions of each specific node can vary according to a desired ventilation and massaging effect. It is preferred however, that the nodes be between 4–9 mm in height and have a width greater than 5 mm. The ventilation ports are preferably between 1–9 mm in height, and more preferably, from about 5–9 mm in height. Such ventilation ports preferably should have a width of at least 5 mm and preferably have a width of from about 5 to 10 mm. The space between the ports is preferably 3 to 8 mm and preferably about 5 mm. Other dimensions, however, can be used to suit specific needs.

Preferably, the ventilation means of the shoe 10 of the present invention generally is comprised by an internal ventilation area 18 defined in the sole portion 14, a plurality of ventilation ports 1 formed on the outer edge of the sole portion 14 and a fiber cushion 9 lining the interior bottom of the upper portion of the shoe 10 (the top of the sole portion 14).

Each of the centered nodes 5 and each of the border nodes 6 are spatially disposed to define the internal ventilation area 18 therebetween. The internal ventilation area 18 within the sole portion 14 therefore is maintained in fluid communication via the spaces formed between each of the center nodes 5 and each of the border nodes 6. The ventilation ports 1 preferably are formed between adjacent border nodes 6, in an alternating manner. The ventilation ports 1, however, also can be formed through each or some of the border nodes 6. Fluid communication between ambient fluids, such as the air in the atmosphere surrounding the shoe 10, and the internal ventilation area 18 is provided by the ventilation ports 1. The multiplicity of the ventilation ports 1 is not critically set, but should be high enough to allow air inside the internal ventilation area 18 to escape via the ventilation ports 1 quickly when the sole portion 14 deforms under a load from a user. One of ordinary skill however would readily appreciate that the firmness of the sole, and thus the firmness of the shoe, is related to the speed in which a fluid exits from the internal ventilation area 18 through the ventilation ports 1. Thus, the number and size of the ventilation ports 1 can be varied to adjust the firmness of the shoe 10 according to any desired level.

The heel 16 of the shoe 10 of the present invention, whether separate from or integral with the sole portion 14, is preferably comprised of several chambers 8 defined by a group of interconnected support members 7. The support members can be arranged in a matrix shape to define rectilinear heel chambers 8 or can be arranged to define any other suitable shape of heel chambers 8. The heel chambers 8 sealably accommodate a fluid, such as air, to provide preferably resilient support for the heel portion 16 of the shoe 10. Alternatively, any known structure of a heel of a shoe, such as a solid rubber, solid wood or a composite rubber and wood heel, can be utilized suitably with the inventive sole portion 14 described herein above. As is readily apparent upon viewing FIGS. 1 and 3, the heel 16 used according to the present invention can be embodied as a high or a flat heel.

The fabric cushion 9 of the present invention preferably provides communication between the interior of the upper portion 12 of the shoe 10 and the interior ventilation chamber 18 of the sole portion 14. As described above, the ventilation chamber 18 is in communication with ambient conditions via the ventilation ports 1 defined through the sole portion 14. Thus, the foot of a user which is inserted in the upper portion of the shoe 10 can "breathe" through the ventilation ports 1, via the fabric cushion 9 and the interior ventilation chamber 18. Foot perspiration and consequential odor therefore are minimized or eliminated by the fabric cushion 9 absorbing and aerating the moisture generated by the foot through the ventilation ports 1.

Preferably, the fabric cushion 9 of the present invention is formed from multiple layers of pure cotton having a final thickness of, i.e, 3–7 mm. The multiple layers can be mutually attached by gluing, sewing, or any other means known to those of ordinary skill in the shoe manufacturing industry. Of course, other types of fibers, natural or synthetic, which allow for the passage of fluids can instead be used to form a suitable fabric cushion 9. The fabric cushion also can be treated with a waterproofing substance which prevents liquids from penetrating the fabric cushion 9 and entering the interior of the shoe 10 but which still provides for the passage of gases.

In a preferred variation, the fabric cushion 9 is infused with a substance of known medicinal attributes. Thus, wearing a shoe 10 which has such an infused fabric cushion 9 prevents and/or treats, for example, athlete's foot or decreases odors due to perspiration of the foot, etc.

Any suitable materials known to those in the shoe manufacturing industry may be used for the present invention, such as rubber for the sole portion 14 and leather for the upper portion 12.

The main manufacturing procedures of a shoe according to the present invention are as follows: the edge of rubber base of the sole first is sanded, then pasted with chloroprene glue (rubber), and wrapped with genuine leather identical to the shoe's top (vamp). The wrapping leather also is sanded so it can later be glued and seamed to the shoe's top (vamp). The shoe upper, lined with leather, cloth and a hard layer, is stretched onto a shoe tree. The fiber cushion 9 (the middle layer) on top of the sole is glued to the shoe upper which has already had its shape adjusted by a shoe tree. This then is nailed and stretched to finalize the shoe shape. Afterwards, the sole is placed in a furnace of, for instance, about 80° C. to dry for about 6 hours. When finished, the nails are removed and the seams are leveled. The fiber cushion and the shoe upper is stitched with silk thread. The seaming requires 3 stitches per inch, with 5 stitches per inch used at the seam. The next step is the sanding and gluing of the edges of the sole and the top so that the final stitching can be completed. The final step is to stitch the previously processed-sole and the shoe top to form the shoe. It requires 3.5 stitches per inch and 3 stitches per inch at the seaming lines. These stitching sizes not only have a pleasant appearance but also produce a durable shoe.

It is to be understood that description set forth above is related merely to preferred embodiments of the present invention. As such, modifications and variations will be readily apparent to those of ordinary skill in the art, these modifications and variations being understood as included within the scope and spirit of the appended claims.

I claim:

1. A sole for a shoe comprising:

a bottom portion and a top portion having an outer edge portion to define a space between said bottom portion and top portion which is a ventilation area;

a plurality of border nodes disposed in said ventilation area and extending from said bottom portion of said sole, each of said border nodes being arranged proximal to said outer edge portion of said sole;

a plurality of central nodes disposed in said ventilation area and extending from said bottom portion of said sole, said border nodes and said central nodes being arranged such that said border nodes at least partially surround said central nodes;

wherein an upper portion of said central nodes are located toward the top of said sole and are located so as to massage a wearer's foot;

at least on ventilation port defined through said outer edge portion of said sole, said ventilation area being in fluid communication with a space outside of said shoe through said ventatilation port;

a heel portion engaged with said sole portion; and a rim disposed proximal to said outer portion and connecting said top portion to said outer portion of said sole;

wherein said heel has an interior chamber defined therein, said interior chamber being divided into a plurality of support chambers by a plurality of support members;

wherein said support members are arranged to define rectangular support chambers in a matrix shape;

wherein said heel and said sole are integral;

wherein said border nodes are more elongated laterally than said central nodes;

wherein said top portion comprises a plurality of cotton layers and is permeable to fluids;

wherein said ventilation area is in fluid communication with an interior of said shoe through said top portion of said sole;

wherein a rim disposed proximal to said outer portion and connecting said top portion to said outer portion of said sole; and wherein said top portion includes a chemical or medicinal substance for application to the wearer's foot of the shoe by close contact therewith.

2. A method of making a shoe comprising manufacturing a shoe using the sole defined in claim 1.

* * * * *